United States Patent [19]

Holson

[11] Patent Number: 4,916,838

[45] Date of Patent: Apr. 17, 1990

[54] PHOTO HOLDER FOR PHOTO ALBUMS

[75] Inventor: Sheldon Holson, Norwalk, Conn.

[73] Assignee: The Holson Company, Forestdale, R.I.

[21] Appl. No.: 208,744

[22] Filed: Jun. 17, 1988

[51] Int. Cl.[4] ..... A47G 1/06

[52] U.S. Cl. ..... 40/159

[58] Field of Search ..... 40/156, 158.1, 159, 40/159.1, 159.2, 611, 649

[56] References Cited

U.S. PATENT DOCUMENTS

| | | | |
|---|---|---|---|
| 2,568,178 | 9/1951 | Widder | 40/159 |
| 2,611,369 | 9/1952 | Herrick . | |
| 2,850,294 | 9/1958 | Ortis . | |
| 3,461,585 | 8/1969 | Roberts . | |
| 3,921,322 | 11/1975 | Sharp | 40/159 |
| 4,140,565 | 2/1979 | Parker . | |
| 4,145,830 | 3/1979 | Desmarais . | |
| 4,378,647 | 4/1983 | Stancato . | |

FOREIGN PATENT DOCUMENTS 3441741 3/1986 Fed. Rep. of Germany .

*Primary Examiner*—Richard J. Apley
*Assistant Examiner*—David Crosby
*Attorney, Agent, or Firm*—St. Onge Steward Johnston & Reens

[57] ABSTRACT

A photo holder is described which can be smoothly applied to a page in a photo album. The photo holder has a peripheral border that nests inside the opening of a retainer frame while a peripheral holding edge fits beneath the frame. In one embodiment the photo holder is formed of a photo mat that is mounted on a backup sheet. The backup sheet is shaped and sized to extend past the photo mat to form the peripheral holding edge with angled sides that converge at a corner to form the protruding region. The photo mat is sized to nest inside the retainer frame. Various embodiments are shown and described including a photo holder with sides so cut that these form corners to facilitate insertion below the edge of the retainer frame.

18 Claims, 4 Drawing Sheets

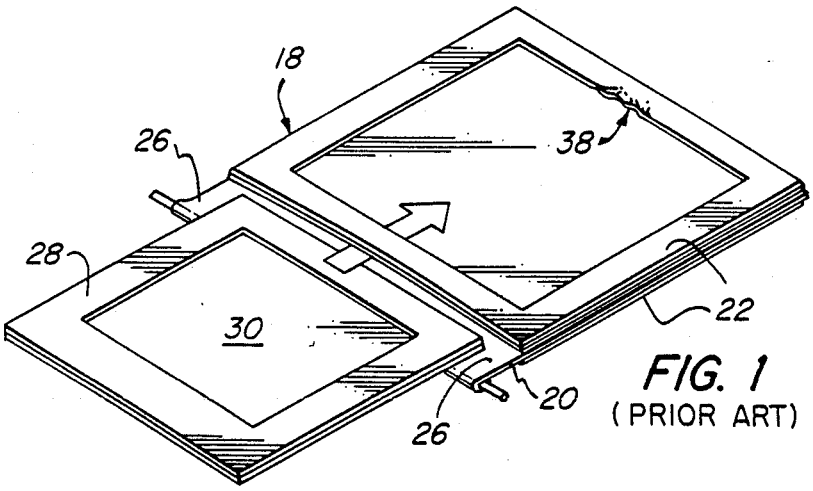
FIG. 1
(PRIOR ART)
FIG. 2
(PRIOR ART)
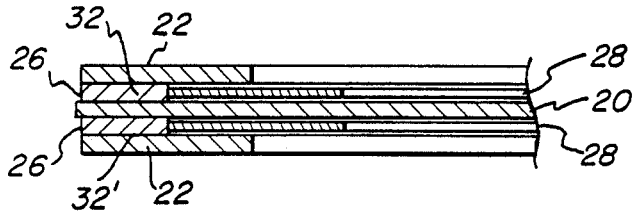
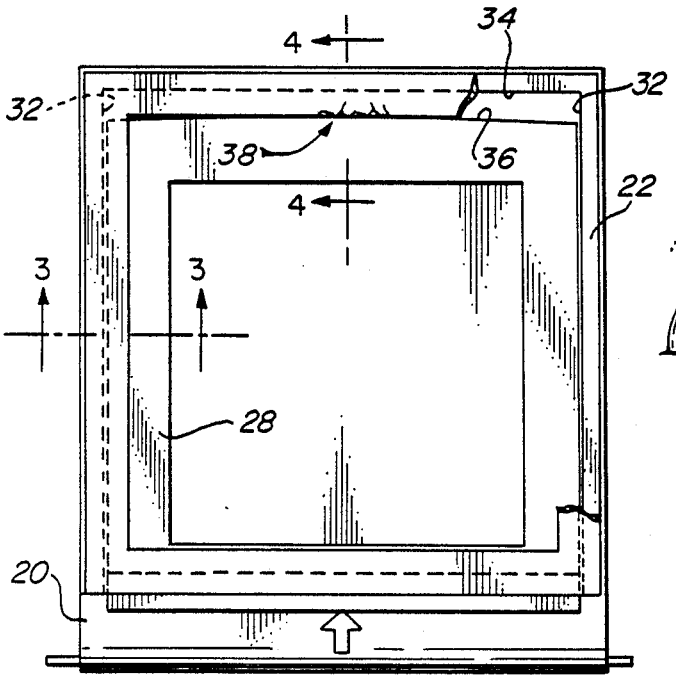
FIG. 3 (PRIOR ART)
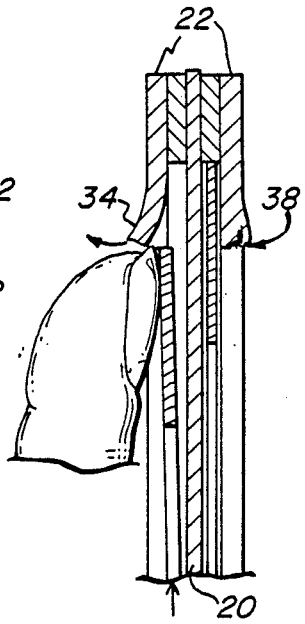
FIG. 4
(PRIOR ART)

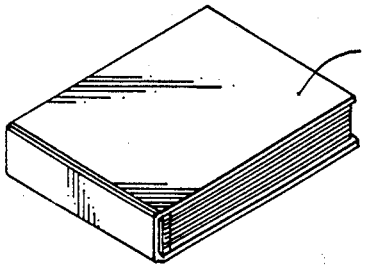
FIG. 5
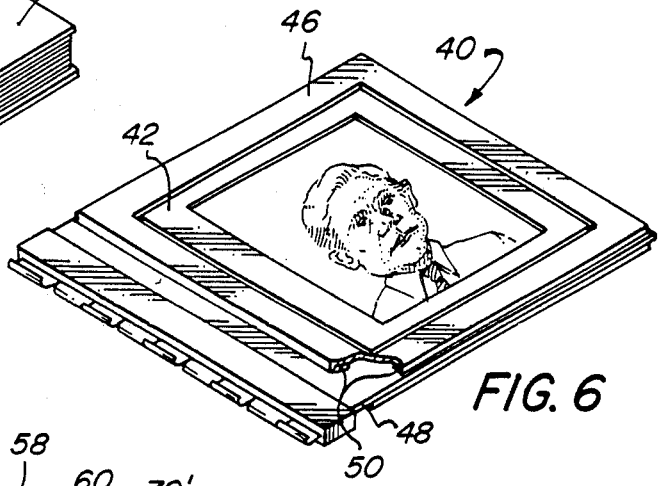
FIG. 6
FIG. 7
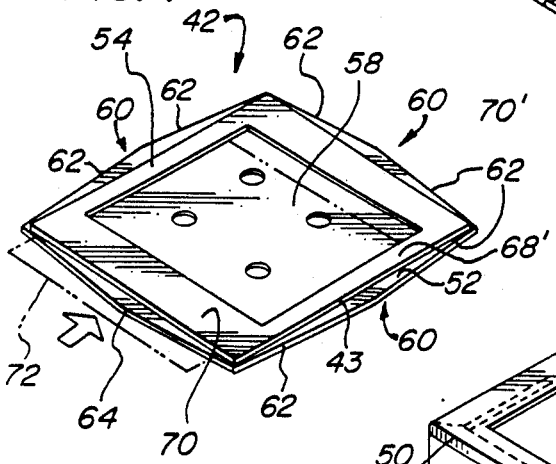
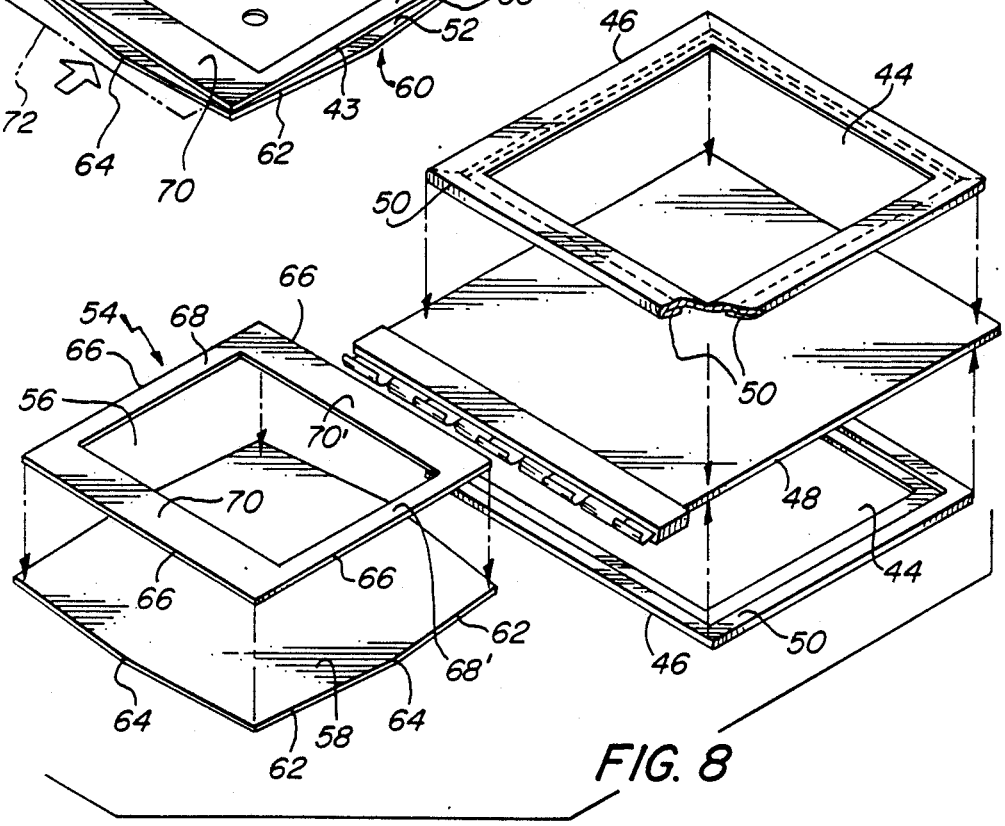
FIG. 8

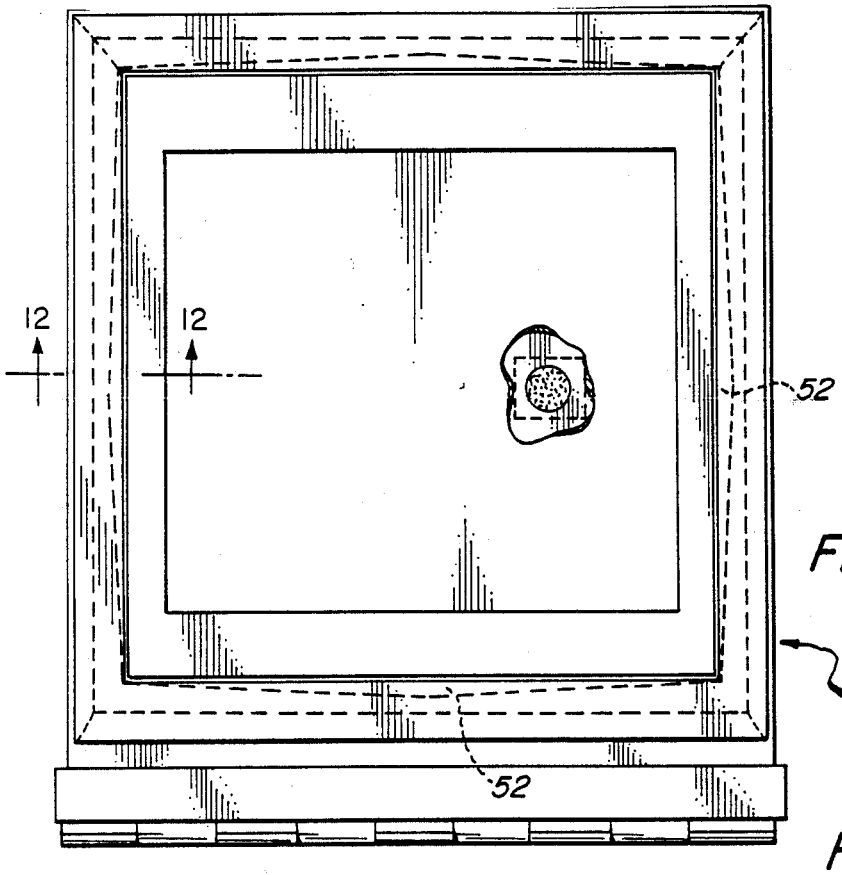
FIG. 11
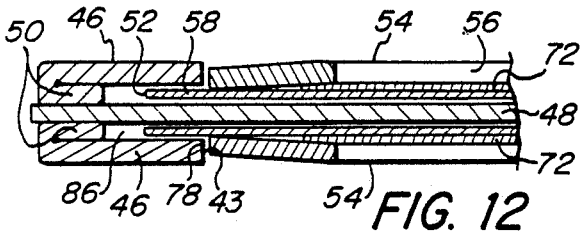
FIG. 12
FIG. 14
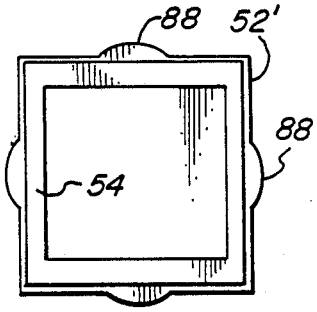
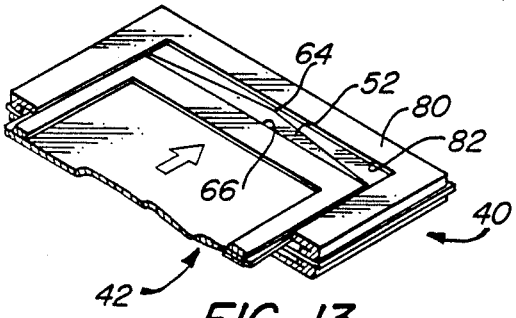
FIG. 13
FIG. 15
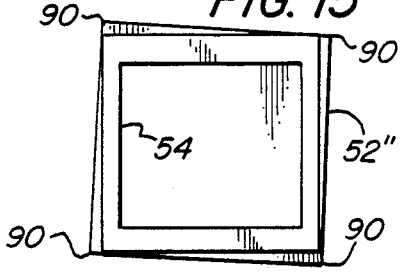

PHOTO HOLDER FOR PHOTO ALBUMS

FIELD OF THE INVENTION

This invention generally relates to photo albums and more specifically to photo holders used as inserts for pages in photo albums.

BACKGROUND OF THE INVENTION

In German patent publication DE No. 34,41,741,A1 (priority for which is claimed in U.S. patent application No. 647,128 filed Sept. 4, 1984), a fastening device is described for a photo album. The page is replaceable in a photo album and includes a panel 20 (see FIGS. 1–4 herein) on to which retainer frames 22 are mounted, each with a square opening 24. A shim margin 26 is affixed around and beneath the perimeter of the panel to provide space to receive a photo mat 28 and capture this mat. A photo opening 30 in mat 28 is provided through which a photo can be viewed. In a commercially available model, the photo mat 28 is made of a single sheet instead of the double-sheet envelope form described in this patent publication.

The disadvantages of such a photo holder are that the photo mat 28 slides underneath the retainer frame 22, creating an overlap which does not accomplish a flush fit as asserted in this patent. The insertion of the photo holder involves difficult guidance along hidden edges 32, 32' of shims 26. An interference problem at the rear edge 34 of retainer frame frequently arises when the front edge 36 of the photo frame is being pushed to fit underneath edge 34. This interference requires one to use a nail or some other device to temporarily lift edge 34 as shown in FIG. 4 to enable edge 36 to be slid beneath retainer frame edge 34. This in turn tends to disfigure the visible rear edge 34 as shown at 38 in FIGS. 1 and 3 creating an unpleasing appearance for photo album pages that are often used to store memorable photos.

U.S. Pat. No. 2,850,294 shows a picture album formed of pages in the form of framed envelopes in which pictures are placed. U.S. Pat. No. 4,145,830 describes an album leaf in which a complex framing structure is employed. U.S. Pat. No. 4,140,565 describes another technique for mounting photos in an album and forming album pages. Other album page constructions are described and shown in U.S. Pat. Nos. 3,461,585 and 4,378,647.

SUMMARY OF THE INVENTION

In a photo holder in accordance with the invention, the photo holder is conveniently insertable in a retainer frame on a page of a photo album without a tendency to produce defacings on the page. This is achieved by providing the insertable holder with a protruding region that is so shaped as to slip easily beneath the retainer frame's rear edge as the photo holder is pushed into place.

In accordance with one aspect of the invention as shown in a preferred embodiment, a substantially true flush frame construction is obtained. This is achieved by employing a photo mat that is so-sized that it nests inside the opening of a retainer frame that is a part of an album page. The photo mat in turn is provided with a protruding lip for ease of insertion below the retainer frame. The protruding lip may be a specially-shaped edge of the photo mat, but preferably is made as part of a backup sheet on to which the photo mat is mounted.

The backup sheet is made slightly larger in area than the photo mat so as to provide a peripheral holding edge when the photo mat is generally centrally-affixed to the backup sheet. The peripheral holding edge is shaped to form a protruding region with which the edge can be conveniently slipped below the rear edge of the retainer frame. With such construction, a photo holder can be reliably and readily put in place without defacement of the retainer frame.

The backup sheet can be made of a thickness that is substantially the same as that of a shim employed below the retainer frame, thus enabling the photo mat to be substantially flush with the retainer frame's exposed surface when the photo mat nests inside the retainer frame's opening. This further enables upper and lower inwardly facing edges along the aperture of the retainer frame to serve as visible and actual guides for upper and lower edges of the photo mat during insertion of the photo holder. The nesting of the photo mat enables it to be cut from the same sheet of which the retainer frame is made.

It is, therefore, an object of the invention to provide a photo holder that is conveniently installed in an album page such as used in professional albums. It is a further object of the invention to provide a photo album page and photo holder that provide a pleasing appearance, yet can be conveniently assembled without defacing of edges and without markings from the handling of the components. It is a further object of the invention to provide a replaceable page holder that uses sheet material in an efficient manner.

These and other objects and advantages of the invention can be understood from the following detailed description of embodiments described in conjunction with the drawings.

BRIEF DESCRIPTION OF DRAWINGS

FIGS. 1–4 are sketches of a prior art photo holder and in which FIG. 1 is a perspective view of a prior art photo page for use in an album;

FIG. 2 is a partial enlarged section view of the prior art photo page and photo holder;

FIG. 3 is a top plan partially broken away view of the prior art photo album page;

FIG. 4 is an enlarged sectional partial view of the prior art photo album page illustrative of a problem encountered therewith;

FIG. 5 is a perspective view of a typical photo album;

FIG. 6 is a perspective view of a photo album page in accordance with the invention;

FIG. 7 is a perspective view of a photo holder in accordance with the invention FIG. 8 is a perspective exploded view of components used for a photo album page and photo holder in accordance with the invention;

FIG. 11 is a top plan view of a photo album page in accordance with the invention;

FIG. 12 is a section view of the photo album page taken along line 12—12 in FIG. 11.

FIG. 13 is a partial perspective view of the insertion of a photo holder in accordance with the invention into a photo album page;

FIGS. 14 and 15 are top plan views of alternative forms for a photo holder in accordance with the invention;

DETAILED DESCRIPTION OF DRAWINGS

Figure 16:
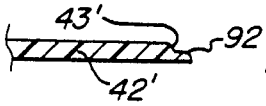
FIG. 16 is a partial sectional view of another photo holder in accordance with the invention.

With reference to FIGS. 5–8, a photo album page 40 for an album 41 is shown including a photo holder 42 with a border 43 that is shaped to nest inside an opening 44 of a retainer frame 46. A pair of retainer frames 46 are affixed to opposite sides of a panel sheet 48.

The retainer frame 46 is affixed to panel 48 with a suitable adhesive or the like placed between folded-over edges 50 and panel 48. The folded-over edges 50 serve as shims by which a small space is provided to receive a peripheral holding edge 52 that extends outwardly from nesting border 43. Shims 50 could be made of separate sheets. The retainer frame opening 44 is preferably symmetrically-shaped such as square or circular so that the photo holder 42 can be inserted with different orientations.

Photo holder 42 is formed with a separately cut photo mat 54 having a photo opening 56. Mat 54 is sized and shaped so that its border 43 nests inside opening 44 of retainer frame 46. In the embodiment of FIG. 7, the peripheral holding edge 52 is formed by a backup sheet 58 to which photo mat 54 is affixed though as further described herein, an edge 52 can be formed on mat 54. Because of the nesting character of photo mat 54, it can be cut from the same sheet from which the retainer frame 46 is made, thus reducing waste of thicker album sheet material.

The backup sheet 58 is shaped and sized so that when photo mat 54 is placed thereon, peripheral holding edge 52 is formed with a protruding guide region 60. This can be made by cutting the backup sheet into a generally octagonal shape with end edges 62 converging at corners 64 to form the protruding region that extends along a portion of the holding edge 52. The photo mat's nesting border 43 is square shaped with sides 66 which are used to guide the photo holder 42 into place on page 40.

In one example of a photo holder 42 in accordance with the invention, the peripheral holding edge 52 employed end edges 62 that were angled at about two and a half (2.50) degrees relative to the adjacent photo mat border 43 to form a wide angled corner 64 of about 175 degrees. This provided a slight but sufficiently effective protruding portion to facilitate insertion of the corner 64 below the retainer frame. Other angular dimensions can be used. The width of the peripheral holding edge 52 in the above example varied from about 0.093 inches (2.38 mm.) at the corners of the photo mat 54 to about 0.250 inches (6.35 mm.) at corners 64. These dimensions also can be changed. For example, the corner 64 may have an angular range between about 160 degrees to about 176 degrees depending upon the acceptable maximum width of peripheral holding edge 52. When multiple corners 64 are employed on a side, the corner angle can be smaller.

As shown in FIG. 7, the photo mat 54 can be adhesively secured to backup sheet by two opposite segments 68, 68′ while the other segments 70, 70′ are left loose to enable a photo 72 to be inserted between mat 54 and the backup sheet 58 while the photo holder 42 is outside page 40.

With reference to FIGS. 9–13, the ease of placing photo holder 42 in a page 40 can be appreciated. The photo holder 42 is initially inserted between the front segment 76 of the retainer frame 46 and panel 48 in such a manner that borders 66 of the photo mat 54 are guided by inner edges 78 bordering opening 44 in retainer frame 46 towards its rear segment 80. A protruding corner 64 first makes contact with segment 80 as shown in FIG. 13. The protruding corner 64 of the relatively thin backup sheet easily slips underneath segment 80. Once the corner 64 is under segment 80, the rest of the adjoining peripheral holding edge 52 at this corner smoothly slides beneath segment 80 until the leading border 66 seats against edge 82.

Once photo holder 42 is seated in page 40, the nesting border 43 fits within the retainer frame 46 and is captured therein while the peripheral holding edge 52 is held by retainer frame 46. As shown in FIG. 12, the exposed surface of photo mat 54 can be substantially flush with the adjoining surface of the retainer frame with but a slight off-set if the thickness of shim 50 is greater than the thickness of backup sheet 58 as may occur when backup sheet 58 is made of different thinner stock than the turned-over edge-shim 50. The resulting page has a pleasing appearance of a frame within a frame. Insertion of the photo holder further is facilitated because the shims 50 are sufficiently spaced from the retainer frame opening 44 and the peripheral holding edge 52 is so sized as to provide a clearance 86. This assures that during insertion of the photo holder 42, no obscured sliding guidance is needed between the edge 52 and shims 50 but that visible slide guidance is obtained between the retainer frame edges 78 and photo holder border 43.

FIGS. 14 and 15 illustrate alternate peripheral holding edges 52′, 52″ respectively. In FIG. 14, edge 52′ is formed with protruding rounded lips 88 and in FIG. 15 the holding edge 52″ is in the shape of a square that is slightly larger in area than photo mat 54 which is mounted in a slightly skewed relationship to form protruding corners 90.

FIG. 16 illustrates an alternate photo holder 42′ formed of a single sheet of material of desired thickness and whose peripheral holding edge 92 is formed by compressing the sheet around its edges. The compression results in a nesting border 43′ from which edge 92 extends with a protruding region as described herein. Attachment of a photo 72 to mat 43′ can be done using conventional techniques such as an adhesive strip applied to the back of mat 42′ and whose adhesive can contact a photo through a hole in the mat.

Figure 17:
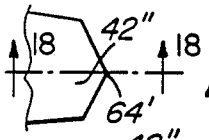
FIG. 17 is a partial reduced plan view of still another photo holder in accordance with the invention.
Figure 18:
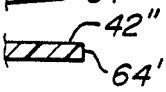
FIG. 18 is a section view of the photo holder of FIG. 17 taken along the line 18—18.
Figure 9:
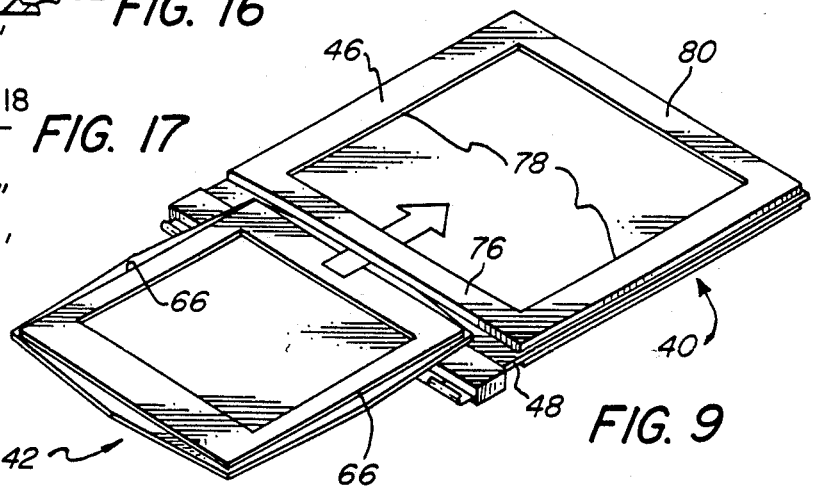
FIG. 9 is a perspective view of a photo album page and a photo holder during installation.
Figure 10:
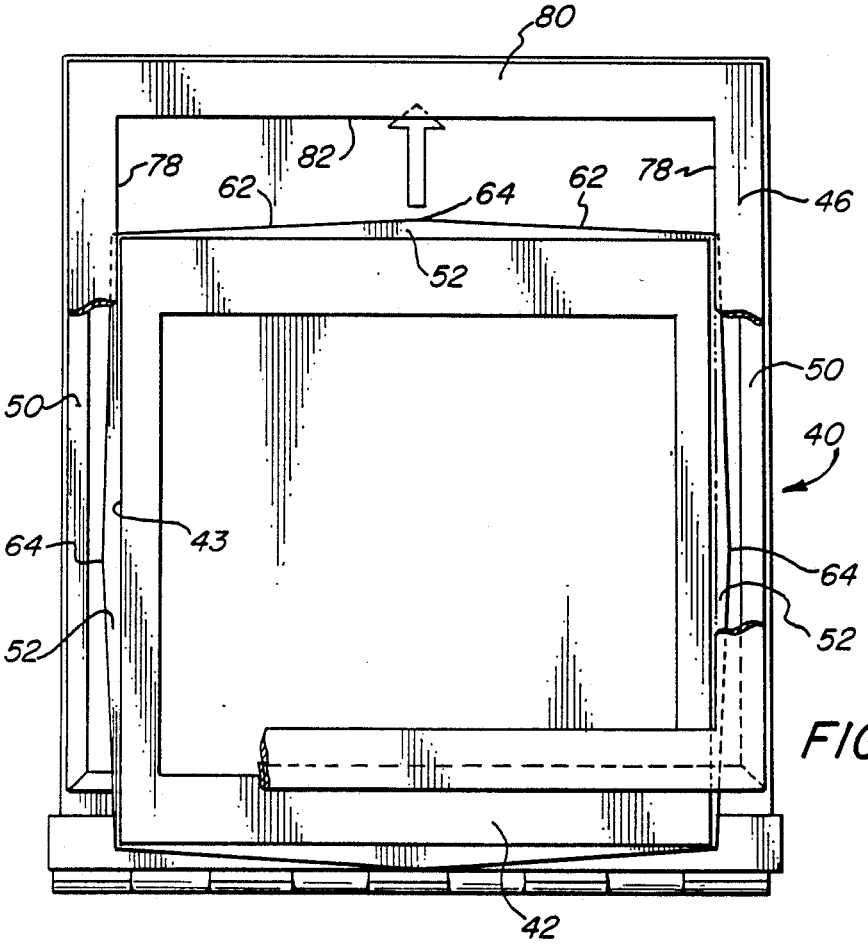
FIG. 10 is a top plan partially broken away view of the photo album page and photo holder during installation.

FIGS. 17 and 18 illustrate still another photo holder 42″ in accordance with the invention and which does not nest within a retainer frame 46 but fits beneath it in the manner as shown in prior art FIGS. 2 and 4. Photo holder 42″, however, is cut into a shape to have protruding regions 60′, of the type described with respect to holder 42 in FIG. 7. The sides of photo holder 42″ are cut along angles to form corners 64′ that are more convenient to slide underneath a retainer frame 46 even though, as shown in FIG. 18, the thickness at the corner 64′ is generally the same as that of the rest of the photo holder sheet. The protruding region may be shaped into a lip or such other shapes as appear effective to easily insert the photo holder.

Having thus described several embodiments of the invention, its advantages can be appreciated. Variations from the illustrated forms can be made without departing from the scope of the invention. For example, the retainer frame, can be made thicker than the photo mat to create the accentuated appearance of a double off-set mat.

What is claimed is:

1. A photo insert for use in a photo album, comprising:

a photo holder;

a panel;

a retainer frame affixed to the panel, said retainer frame being shaped to border a viewing aperture, a side of said retainer frame being unattached to the panel so as to form an entry slit between the panel and the retainer frame for said photo holder;

said photo holder having a peripheral holding edge, said photo holder and its peripheral edge being sized to slidingly fit through said entry slit and extend beneath a retainer frame portion that borders the photo viewing aperture; and includes a rear edge located opposite to the entry slit;

said peripheral holding edge being selectively shaped to have a protruding guide portion that slidingly slips beneath the rear edge of the retainer frame, without its manual defacement when the photo holder is installed.

2. The photo insert as claimed in claim 1 wherein the protruding guide portion has end edges which are oriented to intersect with a wide corner angle relative to each other to form corner shaped protruding regions on sides of the photo holder.

3. The photo insert as claimed in claim 2 wherein the peripheral holding edge corner angle is in the range from about 160 degrees to about 176 degrees.

4. The photo insert as claimed in claim 3 wherein the peripheral holding edge has the shape of an octagon.

5. A photo insert for use in a photo album, comprising:

a photo holder;

a panel;

a retainer frame affixed to the panel, said retainer frame having inner edges that border a viewing aperture surrounded by the retainer frame;

said photo holder having a nesting border that is sized and shaped so as to nest inside the viewing aperture with the inner edges of the retainer frame being adjacent to the nesting border, said photo holder having a peripheral holding edge that extends outwardly from sides of the nesting border and which is sized and shaped to fit beneath a retainer frame portion that borders the viewing aperture and includes a rear edge;

said peripheral holding edge being so shaped so as to have a protruding region of reduced thickness relative to that of the photo holder within its nesting border so as to facilitate sliding of the photo holder peripheral holding edge beneath the retainer frame portion and its rear edge to nest the photo holder in the viewing aperture of the retainer frame when the photo holder is installed.

6. The photo insert as claimed in claim 5 wherein a side of the retainer frame is unattached to the panel so as to form an entry slit for said photo holder and wherein the retainer frame viewing aperture is square shaped and the nesting border is correspondingly shaped, so that nesting border edges of the photo holder are guided by adjacent juxtaposed inner edges of the retainer frame while the peripheral holding edge extends past nesting border edges so as to slidingly fit beneath a juxtaposed aperture inner edge of the retainer frame during installation of the photo holder in a page.

7. The photo insert as claimed in claim 6 wherein the peripheral holding edge has end edges which are oriented at an angle relative to the nesting border to form said protruding regions on sides on the square-shaped nesting border.

8. A photo insert for use in a photo album having a plurality of pages for receiving and retaining the photo inserts that can be viewed through square apertures in retainer frames attached to the pages, comprising;

a photo holder having a square nesting border that is sized to nest inside the apertures of the retainer frames, said photo holder having a peripheral holding edge that extends outwardly from each side of the nesting border and which is shaped to slip beneath a rear edge of the retainer frame;

said peripheral holding edge being so shaped so as to have a protruding region of reduced thickness relative to that of the photo holder within its border, said protruding region having at least first and second end edges which are oriented at an angle relative to the nesting border so as to intersect at a projecting apex that can slide beneath the retainer frame and its rear edge, so that nesting border edges of the photo holder are guided by adjacent juxtaposed aperture edges of the retainer frame while sliding apices of the photo holder peripheral holding edge beneath a retainer frame and its rear edge to nest the photo holder in an aperture when the photo holder is installed in a page.

9. The photo insert as claimed in claim 6 wherein said peripheral holding edge protruding region is in the form of a protruding rounded lip.

10. The photo insert as claimed in claim 5 wherein the photo holder comprises a backup sheet and a photo mat generally centrally placed on the backup sheet, the photo mat being so sized that its perimeter forms said nesting border, said backup sheet being sized and shaped so as to extend past the nesting border and provide said peripheral holding edge with a protruding region that extends past the sides of the nesting border.

11. A photo insert for use in a photo album, comprising:

a photo holder;

a panel;

a retainer frame affixed to the panel, said retainer frame being shaped to border a viewing aperture, a side of said retainer frame being unattached to the panel so as to form an entry slit between the panel and the retainer frame for said photo holder;

said photo holder being formed of a backup sheet and a photo mat attached thereto, said photo mat being of corresponding shape as the viewing aperture so as to nest inside thereof;

said backup sheet being sized to pass through the entry slit with the photo mat being so located thereon that the backup sheet extends past perimeter sides of the photo-mat to form peripheral holding edges which fit beneath a retainer frame portion that borders the viewing aperture;

said peripheral holding edge of the backup sheet further being shaped so as to have a protruding guide portion that facilitates sliding of the holding edge of the backup sheet beneath the retainer frame portion and smoothly slip underneath a rear edge thereof.

12. The photo insert as claimed in claim 11 wherein the thickness of said photo mat is selected so that its exposed surface is substantially flush with an exposed surface of the retainer frame.

13. The photo insert as claimed in claim 11 wherein said backup sheet further is symmetrically-shaped so as to provide like-sized holding edge segments past respective sides of the photo mat;

each of said holding edge segments having a protruding guide portion that is shaped to enable the holding edge portion to slip beneath the retention frame to nest the photo mat inside an aperture of the retention frame when the backup sheet and photo mat are installed on a page.

14. A photo insert for use in a photo album having a plurality of pages for receiving and retaining the photo inserts that can be viewed through apertures in retention frames attached to the pages, comprising:

a symmetrically octagon-shaped backup sheet and a photo mat affixed thereto, said backup sheet being sized and the photo mat being so located thereon that the backup sheet extends past sides of the photo mat to form holding edge segments having said corners;

said holding edge segments of the backup sheet being shaped so as to have protruding guide portions that slidingly step beneath a retention frame when the backup sheet and photo mat are installed on a page, said protruding guide portions being formed with end edges of the octagon-shaped backup sheet, said end edges being oriented at angles with adjacent sides of the photo mat and intersect at corners that are generally midway of the holding edge segments.

15. The photo insert as claimed in claim 13 wherein said backup sheet has the shape of a square that is larger in area than the photo mat and wherein the photo mat is mounted in skewed relationship on the backup sheet to form said protruding guide portions at corners of the backup sheet.

16. The photo insert as claimed in claim 13 wherein said retention frames have square-shaped apertures and said photo mat has a border with a shape and size that corresponds with that of the square-shaped aperture to nest within it so that upper and lower perimeter edges of the photo mat are visibly guided by adjacent juxtaposed edges of the aperture in the retention frame during installation of the photo holder in the retention frame.

17. A photo insert for use in a photo album having a plurality of pages for receiving and retaining the photo inserts, comprising:

a panel;

a retainer frame affixed to the panel, said retainer frame being shaped so that a portion thereof borders a viewing aperture, said frame portion being raised from said panel to form spaces therebetween and bordering said viewing aperture;

a backup sheet and a photo mat affixed thereto so as to receive a photo between them;

said photo mat having a nesting border that is sized to nest with and inside the viewing aperture of the retainer frame with sides of the nesting border in adjacent relationship with viewing aperture facing edges of the retainer frame portion;

said backup sheet being sized to extend past sides of the photo mat with protruding holding edge segments that slidingly fit into the spaces between the panel and the retainer frame portion, there being protruding holding edge segments on a sufficient number of sides of the photo mat so as to enable the photo mat to be moved into a nesting position by sliding the protruding holding edge segments within oppositely-located spaces and slip beneath a rear edge of the retainer frame.

18. The photo insert as claimed in claim 17 wherein the thickness of the backup sheet and the photo mat are selected so as to place an outer surface of the nesting photo mat substantially-flush with an outer surface of the raised retainer frame portion.

* * * * *